US007815069B1

(12) United States Patent
Bellofatto et al.

(10) Patent No.: US 7,815,069 B1
(45) Date of Patent: Oct. 19, 2010

(54) COLLAPSIBLE INSULATED COOLER

(75) Inventors: Richard C. Bellofatto, Peabody, MA (US); Mark T. Salander, Barrington, RI (US)

(73) Assignee: Gemline, Lawrence, MA (US)

( * ) Notice: Subject to any disclaimer, the term of this patent is extended or adjusted under 35 U.S.C. 154(b) by 592 days.

(21) Appl. No.: 11/760,209

(22) Filed: Jun. 8, 2007

(51) Int. Cl.
*B65D 6/00* (2006.01)

(52) U.S. Cl. ..... 220/666; 383/97; 190/903; 220/9.2; 220/904

(58) Field of Classification Search ..... 220/9.2, 220/666, 904; 190/903; 383/97
See application file for complete search history.

(56) References Cited

U.S. PATENT DOCUMENTS

| | | | | |
|---|---|---|---|---|
| 3,443,397 | A | 5/1969 | Donovan et al | |
| 3,743,130 | A | 7/1973 | Jorgensen | |
| 4,514,993 | A | 5/1985 | Johnson | |
| 4,612,781 | A | 9/1986 | Swerdon | |
| 4,759,077 | A | 7/1988 | Leslie | |
| 4,802,344 | A | 2/1989 | Livingston et al. | |
| 5,022,549 | A | 6/1991 | Beaver | |
| 6,082,896 | A | 7/2000 | Pulli | |
| 6,520,365 | B2 | 2/2003 | Schneider | |
| 2003/0106895 | A1 * | 6/2003 | Kalal | 220/9.2 |
| 2007/0175900 | A1 * | 8/2007 | Richardson | 220/484 |
| 2008/0173135 | A1 * | 7/2008 | Beard | 81/3.09 |

* cited by examiner

*Primary Examiner*—Anthony Stashick
*Assistant Examiner*—Elizabeth Volz
(74) *Attorney, Agent, or Firm*—William A. Loginov; Loginov & Associates, PLLC

(57) ABSTRACT

A collapsible, soft-sided, insulated cooler or other container having a top, a sidewall having a sidewall top connected to the rim of the top and a bottom connected at a sidewall bottom, opposite the top. The top includes a zipper or other closure that extends from a first point to a second point on the rim of the top in a line along a radial segment, traversing a central region of the top. The sidewall comprises an inner layer, an outer shell and an insulating material disposed therebetween. The sidewall further includes a spring wire that extends between the bottom and top of the container that biases the cooler to a fully expanded configuration for use and that is compressible for storage by pressing down on the top.

8 Claims, 10 Drawing Sheets

COLLAPSIBLE INSULATED COOLER

FIELD OF THE INVENTION

This invention relates to soft-sided coolers and non-disposable insulated containers for carrying food.

BACKGROUND OF THE INVENTION

Insulated, soft-sided coolers, lunch bags and similar containers are a popular item to carry on a picnic, trip or to an event. They are available in a wide range of sizes and shapes. Many are constructed from cloth or polymer sheet outer shell with a liner that resists moisture. The liner may be removable, or permanently attached. Between the liner and the outer shell is often disposed an insulating material, though an empty air space therebetween is also a relatively good insulator, absent a filler material.

Most coolers and lunch bags include a sealed lid that retains the container's content's and reduces heat transfer between the bag interior and the external environment. The lid may be a simple flap that overlap's the container's side(s) and is secured by a fastener (e.g. hook-and-loop material, a snap, etc.). Alternatively, the lid may be a closely fitted flap of insulated material that hinges on a side of the container and is secured to the adjacent sides of the container by a zipper or similar type of continuous securing mechanism. This type of continuous seal is quite effective at reducing heat transfer.

While soft-sided, insulated containers may typically be flattened for storage, this may cause them to deform, and become permanently wrinkled over time. As such, it may prove harder to place items efficiently within the container's interior after it is unflattened, and the container may display an undesirable, rumpled shape.

It is, thus, desirable to provide a container that flattens to minimize its volume when not in use, but that can be immediately placed in an expanded shape that does not suffer from permanent wrinkles or deformation due to flattening. It is also desirable to provide a unique lid construction that is unaffected by the flattening of the container, and that restricts unwanted heat transfer and moisture loss.

SUMMARY OF THE INVENTION

This invention overcomes disadvantages of the prior art by providing a soft-sided, insulated cooler or other container that is spring loaded so that it completely restores its expanded shape from a collapsed orientation. The container is constructed with a fabric outer shell and a moisture-resistant inner lining, with an insulator therebetween. The insulator can consist of an internal airspace only, or can include an appropriate insulating filler. The exterior face of the outer shell includes a spring that spirals continuously around the perimeter of the container sidewall surface between the base and the top of the container. In an illustrative embodiment, the container sidewalls (inner and outer side layers) define a cylindrical shape and the spring wire is attached to the outer shell by an overlying, stitched fabric covering. In alternate embodiments, the container can define another geometric shape and the spring wire can be attached to the layers of the sidewalls. The top lid of the container defines a fixed section that extends from the sidewalls, and a flap that is hinged to the sidewalls at an opposing location and that is removably secured to the fixed section by a zipper or other fastener system. The zipper defines a curvilinear shape, which extends along a first portion of the seam between the top and the sidewalls and then inwardly in a partial curve across a central region of the top to a second location adjacent to the seam between the top and the sidewall, generally opposite the first portion of the seam. In an illustrative embodiment, the container includes a pair of strap handles mounted to remote locations along the sidewalls adjacent to the top. The handles each include a fastener member (hook-and-loop fastener, for example) that engages a corresponding fastener member on the bottom side of the container. The handles and fastener members are sized and arranged so that they engage when the sidewalls are fully collapsed under spring pressure. The engagement maintains the collapsed configuration until the handles are disengaged from the bottom fasteners.

In a further embodiment, the fixed portion of the top can include a pocket with or without a securing closure (hook-and-loop, for example), which can store various items or an ice pack. The container can also include a retractable bottle opener or another tool on a spring-loaded lanyard that is permanently or removably mounted to the container at, for example the seam between the top and sidewall. In one embodiment, the spring-loaded container for the lanyard is encased in material with an end sewed to the seam. The top or other surface of the container can include an appropriate logo, monogram or applied decoration.

BRIEF DESCRIPTION OF THE DRAWINGS

The invention description below refers to the accompanying drawings, of which.

DETAILED DESCRIPTION

Figure 1:
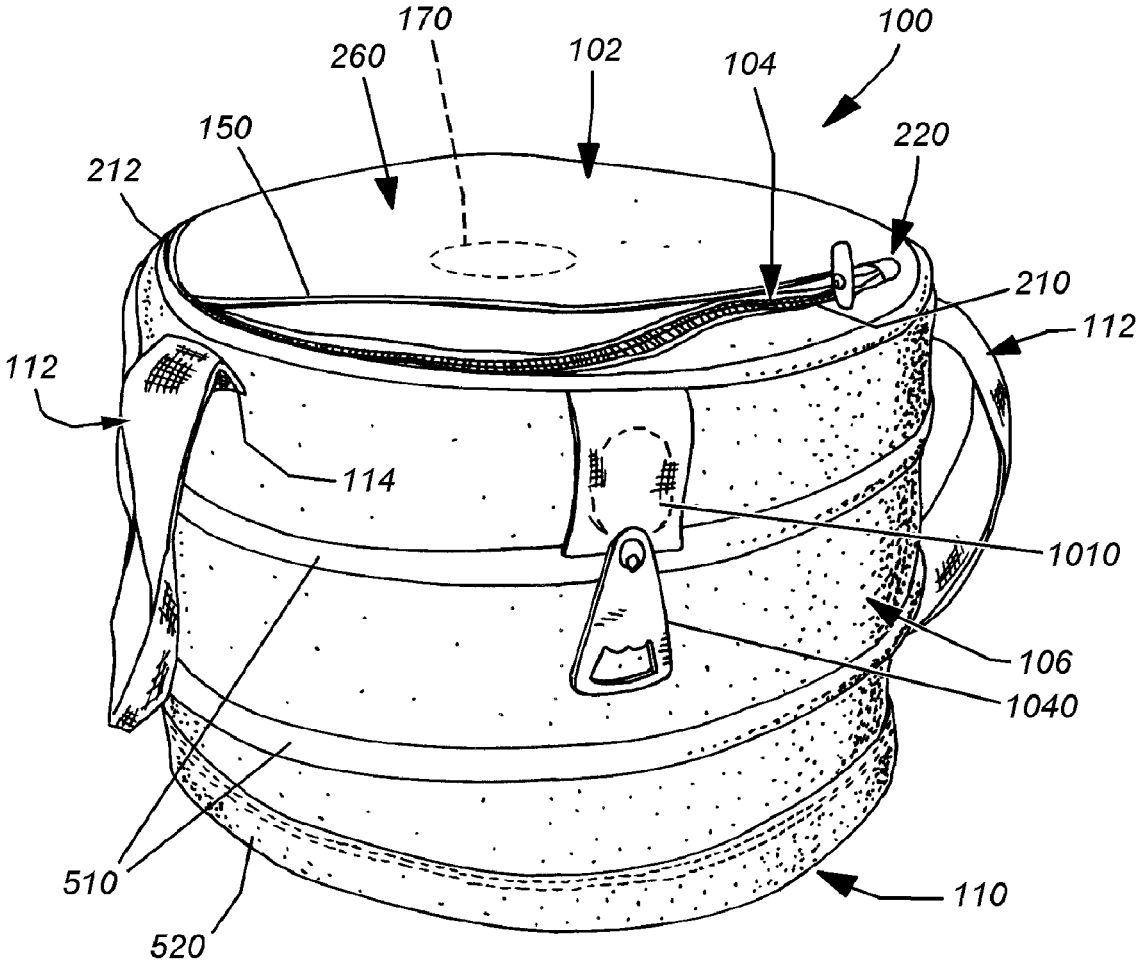
FIG. 1 a perspective view of the collapsible, insulated cooler in an expanded orientation according to an illustrative embodiment of the invention.

FIG. 1 shows a perspective view of a collapsible cooler 100 according to an embodiment of this invention. The cooler 100 is shown with its top 102 in a closed position, sealed by an exemplary zipper 104. The top covers a cylindrical body that is defined particularly by an insulated sidewall 106. A cooler bottom 110 is connected at the rim of the sidewall, opposite the top. A pair of loop handles 112 are joined at two remote locations along the sidewall 106. These handles are formed from woven webs in this embodiment, but alternatively, other types of appropriate handle material can be employed. While not shown, a base for a shoulder strap can also be provided. In one embodiment, the free ends 114 of each of the loop handles 112 are joined to the sidewall by stitching, or another appropriate attachment mechanism.

Figure 2:
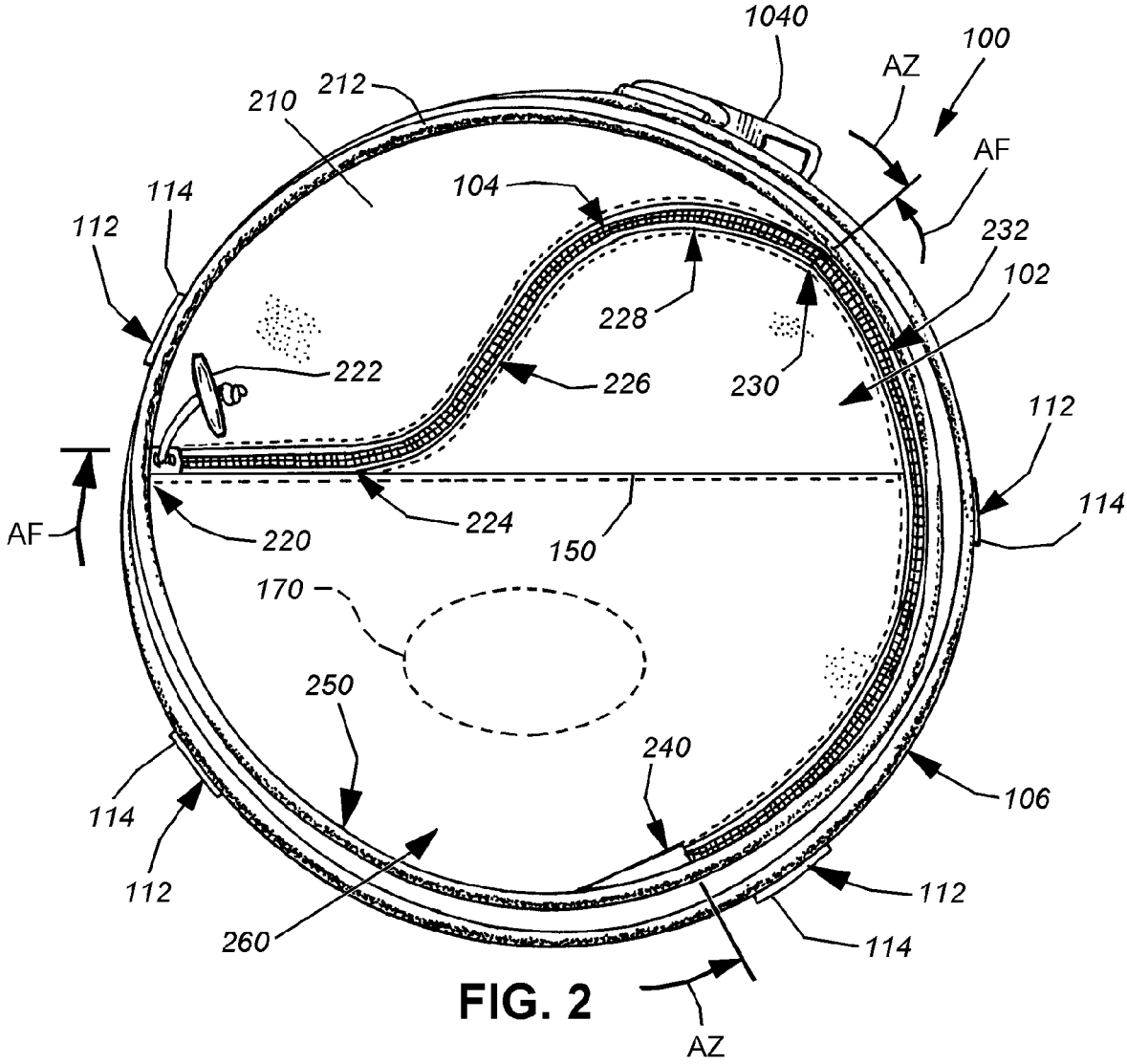
FIG. 2 is a top view of the cooler of FIG. 1 showing the lid in a secured position.
Figure 3:
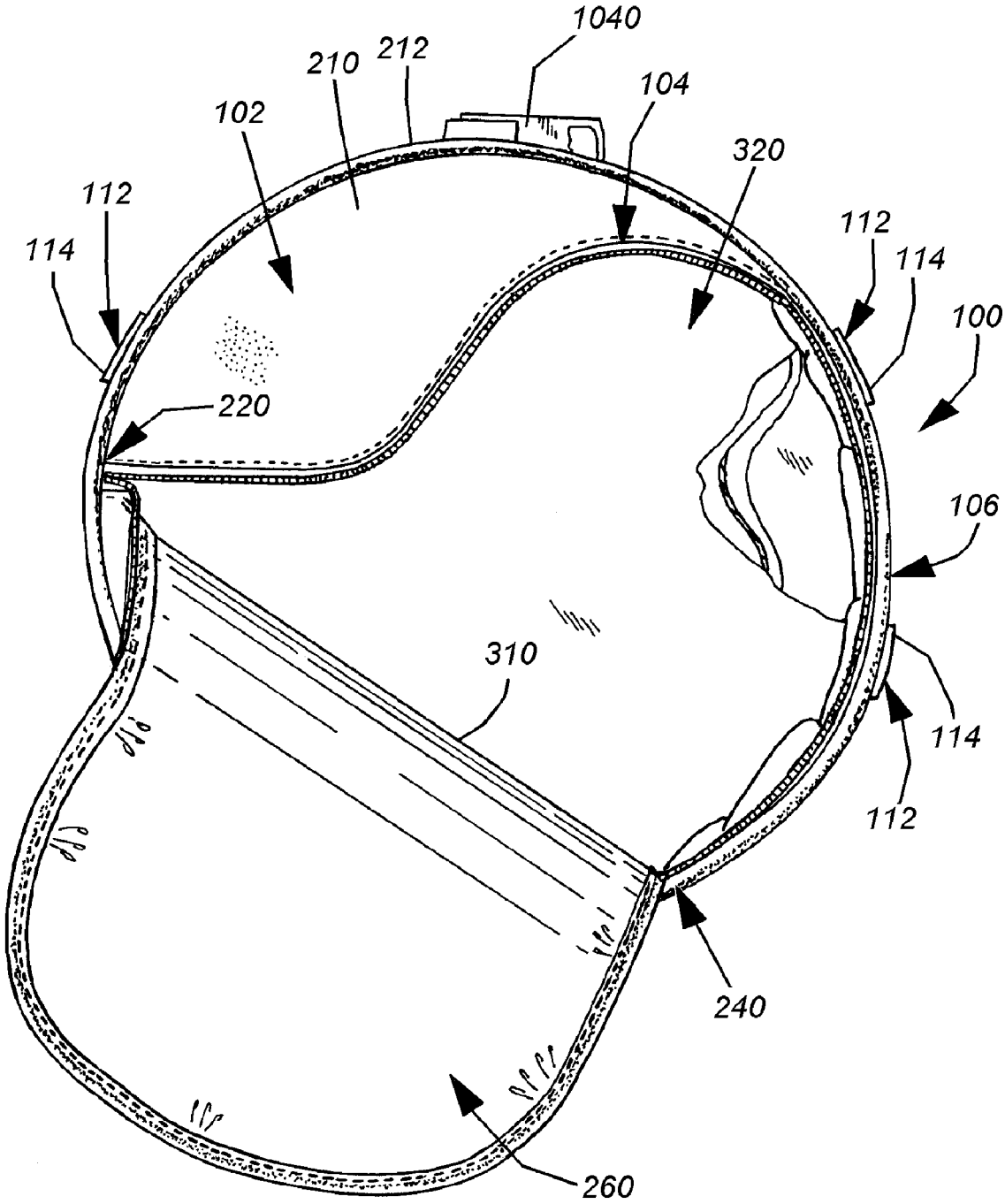
FIG. 3 is a top view of the cooler of FIG. 1 showing the lid in an opened position so as to reveal the interior, the interior bottom being shown in partial cutaway.

Further reference is now also made to FIGS. 2 and 3, which show the cooler top 102 in a closed and opened position, respectively. The top 102 consists of a fixed piece 210 that is secured to the top rim 212 of the cooler around a portion of the perimeter thereof that spans an arc AF that is between approximately one hundred degrees and one hundred eighty degrees in an exemplary embodiment. The zipper 104 extends from a first point 220 near the rim 212. As shown, the zipper's closure member 222 is placed in a fully closed position at this point 220. The zipper 104 extends from this point 220 in a line along a radial segment 224 that transitions into an S-shaped segment 226 within the central region of the top 102. This S-shaped segment 226 defines a gradual curve 228 near an opposing point 230 on the rim. Overall, the combination of contiguous zipper segments 224, 226 and 228 extend across the rim between points 220, 230 that define the arc AF. The zipper 144 then continues its extension from point 230, adjacent to the rim 212 in a segment 232 that extends from the point 230 to an endpoint 240 in a rim-following arc AZ. The angle of this adjoining arc AZ between the points 230 and 240 is highly variable, but in this exemplary embodiment, it is between approximately fifty degrees and one hundred twenty degrees. The remaining rim segment 250 is a permanent joint between the sidewall 106 and a flap portion 260 of the top 102.

As shown in FIG. 3, when the zipper 104 is pulled fully around to the end point 240, the flap portion 260 is allowed to hinge along a section of its body 310 residing generally between the two zipper endpoints 220 and 240. The fixed top portion 210 remains in place, while the flap portion 260 can be pulled away as shown revealing the interior 320 of the cooler 100. Hence, part of the top 210 remains unchanged and fixed to its portion of the rim, while the flap portion 260 is moved mostly out of its covering orientation with respect to the interior 320. In this embodiment, the flap portion 260 of the top 102 also includes an external pocket section defined by a rim opening 150. Hence, the flap section 260 includes at least two layers, which allow contents to be passed therebetween. An appropriate closure (not shown) such as a hook-and-loop fastener assembly can be provided between the pocket layers adjacent the opening rim 150. The flap portion 260 or any other portion of the container can include decorations, monograms, logos, or other printed/applied ornamentation, represented generally by the depicted phantom oval 170.

Figure 4:
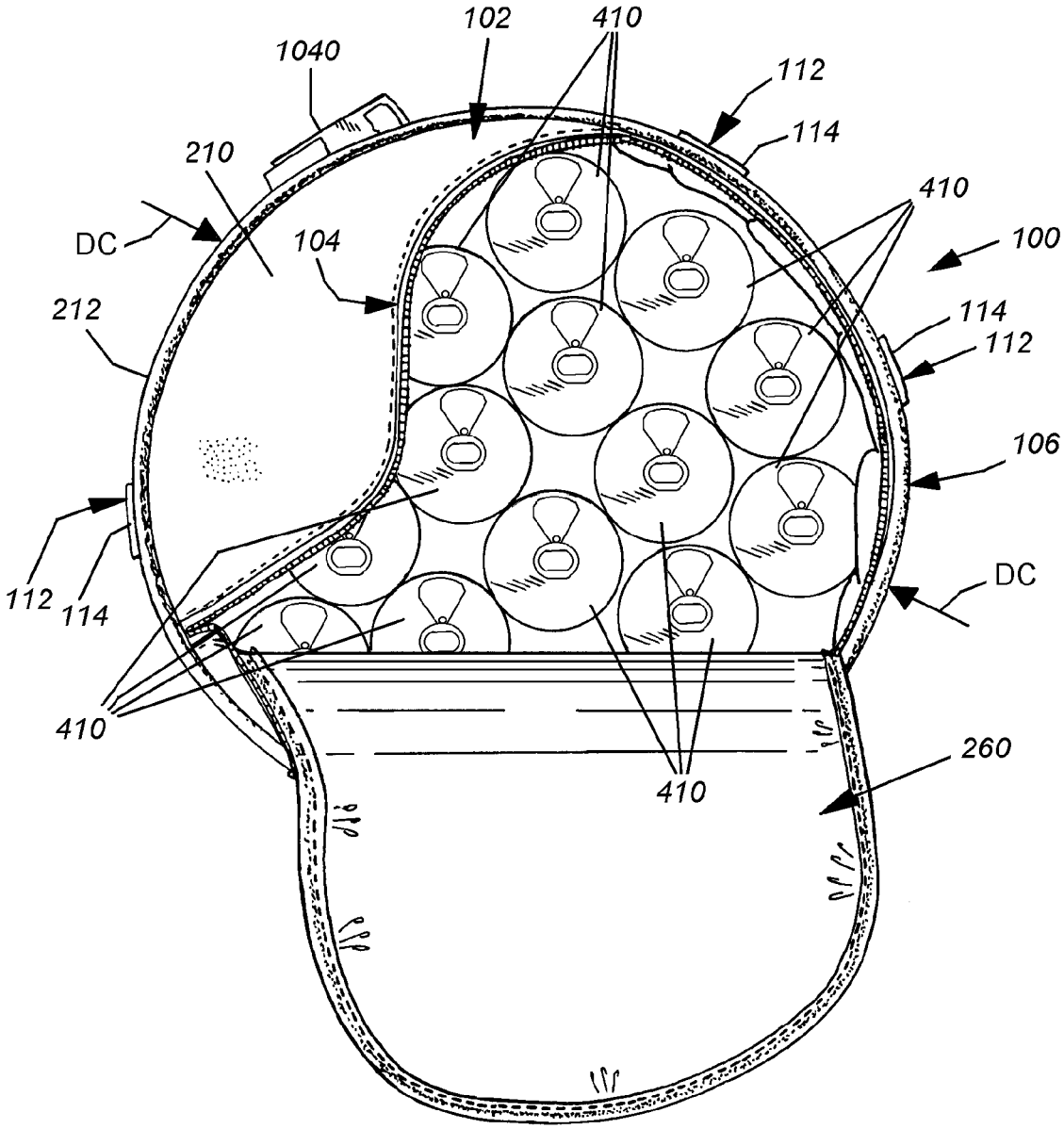
FIG. 4 is a top view of the cooler of FIG. 1 showing the lid in an opened orientation and storing a plurality of exemplary beverage cans therein.

The size and shape of a collapsible cooler in accordance with this invention is highly variable. As shown in FIG. 4, it can be dimensioned to hold a plurality of conventional drink cans 410. In one embodiment, the diameter of the cooler DC is approximately 12 to 16 inches. However, other diameters, heights and shapes are expressly contemplated within the spirit and scope of this invention. In addition, the precise shape and layout of the zipper line is also highly variable. In alternate embodiments, a collapsible cooler in accordance with the teachings of this invention can include a flap that, in essence, fully encircles a large portion of the rim without providing for the interconnected fixed portion (210) as shown and described.

Figure 5:
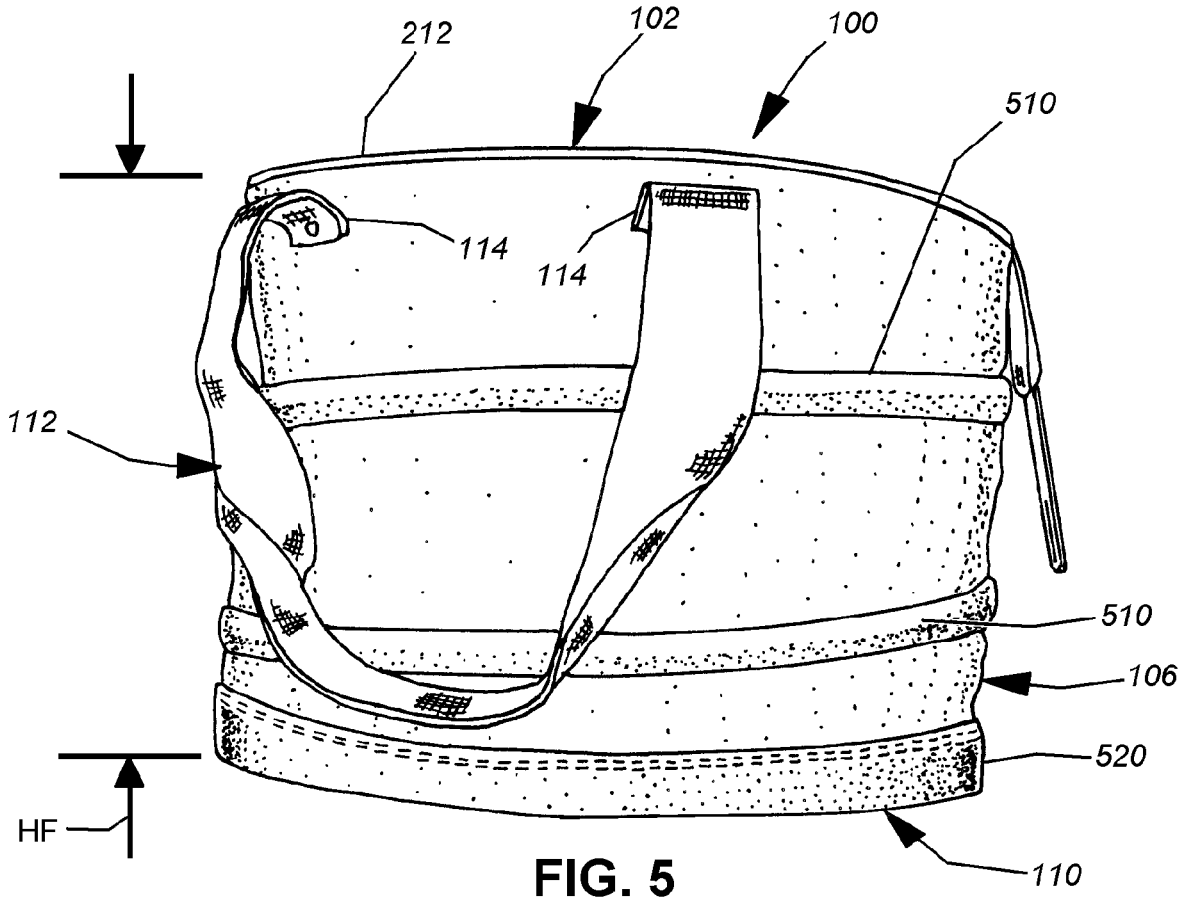
FIG. 5 is a side view of the cooler of FIG. 1 in the expanded orientation.
Figure 6:
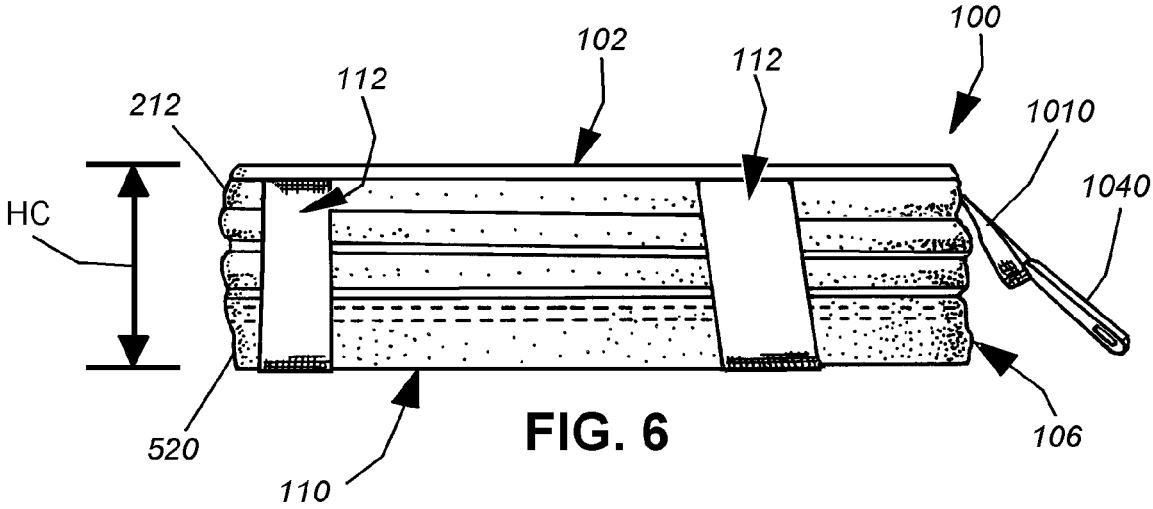
FIG. 6 is a side view of the cooler in a collapsed or compressed orientation with the handles secured to the bottom side.
Figure 7:
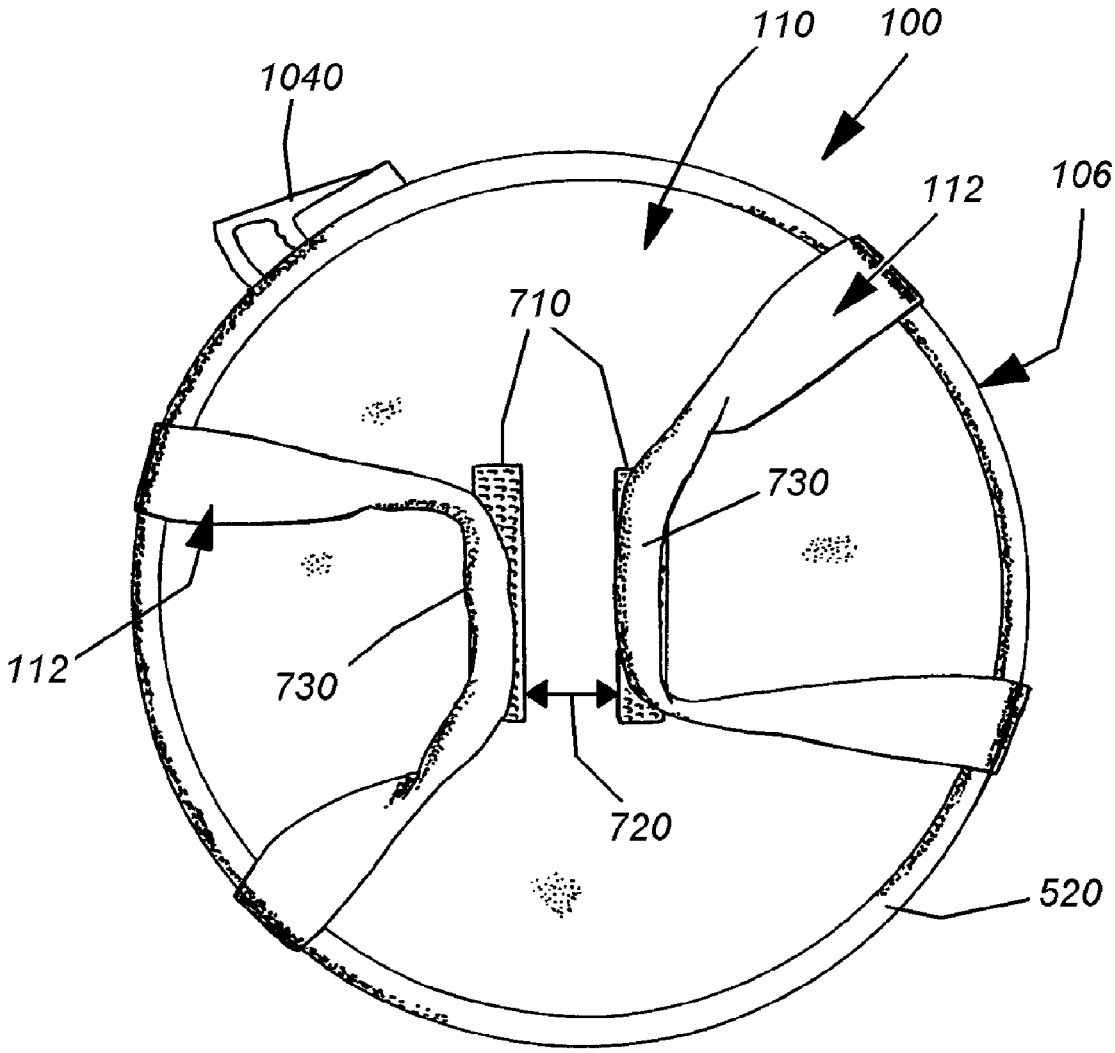
FIG. 7 is a bottom view of the cooler of FIG. 1 with the handles secured in accordance with the collapsed orientation of FIG. 5.

Reference is now made to FIGS. 5-7, which show in further detail the collapsible feature of this invention. In FIG. 5, the cooler 100 is shown fully expanded with its sidewall 106 defining a relatively straight cylinder. In practice, the depicted wrinkles and folds may be present, but overall, the shape of the expanded cooler 100 is that of elongated cylinder (or other geometric shape as appropriate). An externally applied fabric strip 510 encircles the sidewall 106 along its exterior. As described further below, (FIG. 8) this strip 510, encases a plurality of loops of a spring wire that extends between the top rim 212 and the bottom rim 520. The internal details of this spring are described further below with reference to FIG. 8. The strip 510 can be adhered to the sidewall material 106 using stitching, adhesives, welding or any other acceptable technique. The spring in this embodiment acts as a compression spring, and in a resting state is adapted to push outwardly so as to expand the top rim 212 relative to the bottom rim 520 until the material of the sidewalls 106 is stretched out to its fullest extent. This maximum expansion is shown, for example, in FIGS. 1 and 5.

In order to save storage space when the cooler is not in use, a user may press down on the top rim 212 with respect to the bottom rim 520 to generate the compressed profile shown generally in FIG. 6.

With further reference to FIGS. 6 and 7, when the user has fully compressed sidewalls of the cooler to lower its profile to a minimum, compressed height HC (FIG. 6) from a fully-extended height HF (FIG. 5), the compressed state is retained using the two handles 112. In particular, as shown in FIG. 7, the bottom 110 of the cooler 100 includes a pair of hook and loop fastener pieces 710. The location of the fasteners 710 is highly variable. In this embodiment, they are placed in a space-apart relationship (spacing 720) and extend along parallel lines as shown. They are particularly positioned to align with the ends 730 of the handles 112. In this embodiment, the handles are sized so that the ends may be laid in an elongated fashion along the fastener strips 710. The handles include corresponding hook and look fastener strips, or a tufted material that provides appropriate engagement with (for example) the hook portion of a hook and loop fastener. By securing the handle in 730 to the strip 710 as shown, the handles are placed in tension against the expansive biasing force of the sidewall spring. The hold-down force of the handles, when engaged with the strip 710 is sufficient to maintain the cooler in a collapsed state. By releasing the handles from the strips, the cooler is aloud to expand to its full height HF (FIG. 5). It is expressly contemplated, in alternate embodiments, that the fasteners can be snaps, class or other mechanisms that releasably engage the handles. Likewise, in another alternate embodiment, the handles can, themselves be arranged to removeably engage each other. For example, one handle can include a strap that removeably wraps around the end of the opposing handle. In still other embodiments, the collapsed state can be maintained restrained using straps that extend between the top and bottom of the cooler, and removable engage in the collapsed state. In the depicted embodiment, the use of the handles to act as a securing mechanism provides the cooler with cleaner lines and fewer excess straps. This technique also lowers assembly costs by minimizing the number of attached straps or other fasteners.

Figure 8:
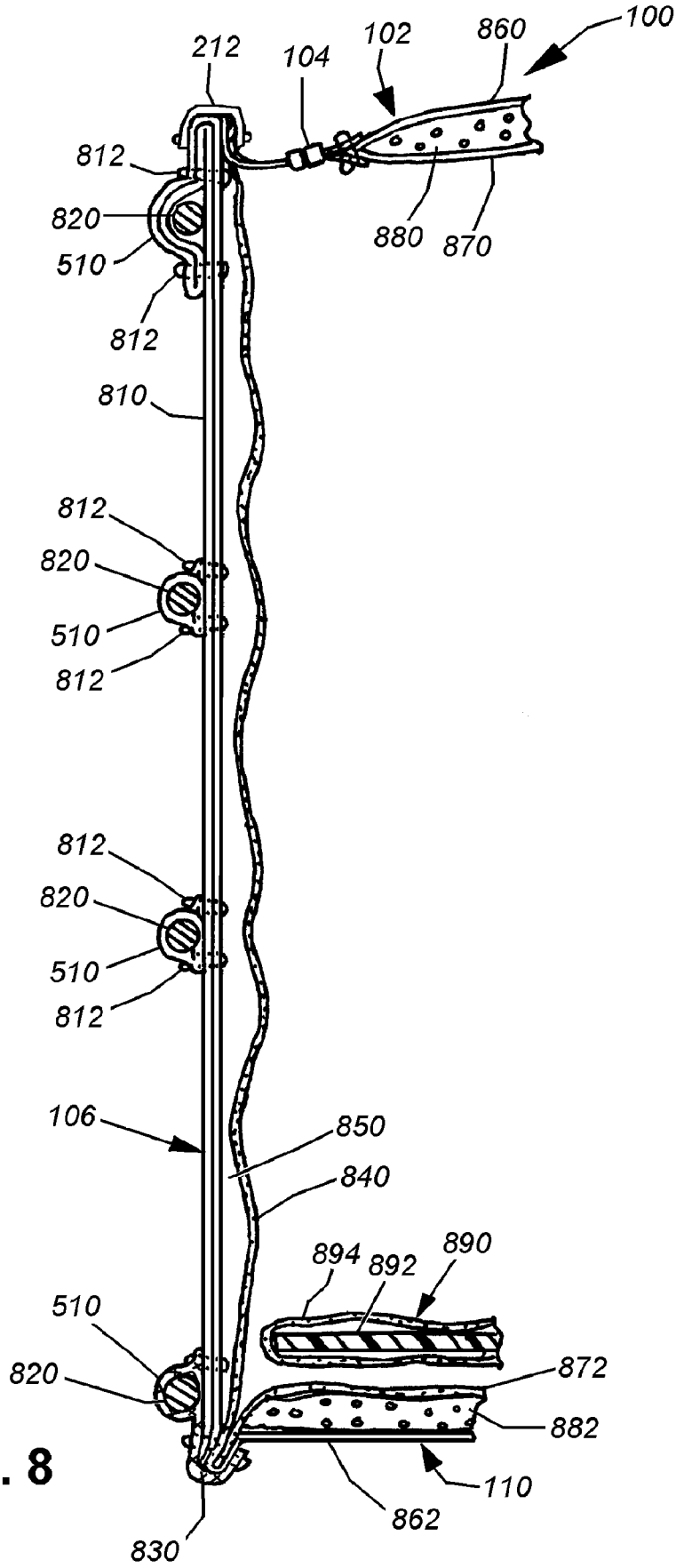
FIG. 8 is a partial side cross section of the side wall and a portion of the top and bottom surfaces of the cooler of FIG. 1 in the expanded orientation.
Figure 9:
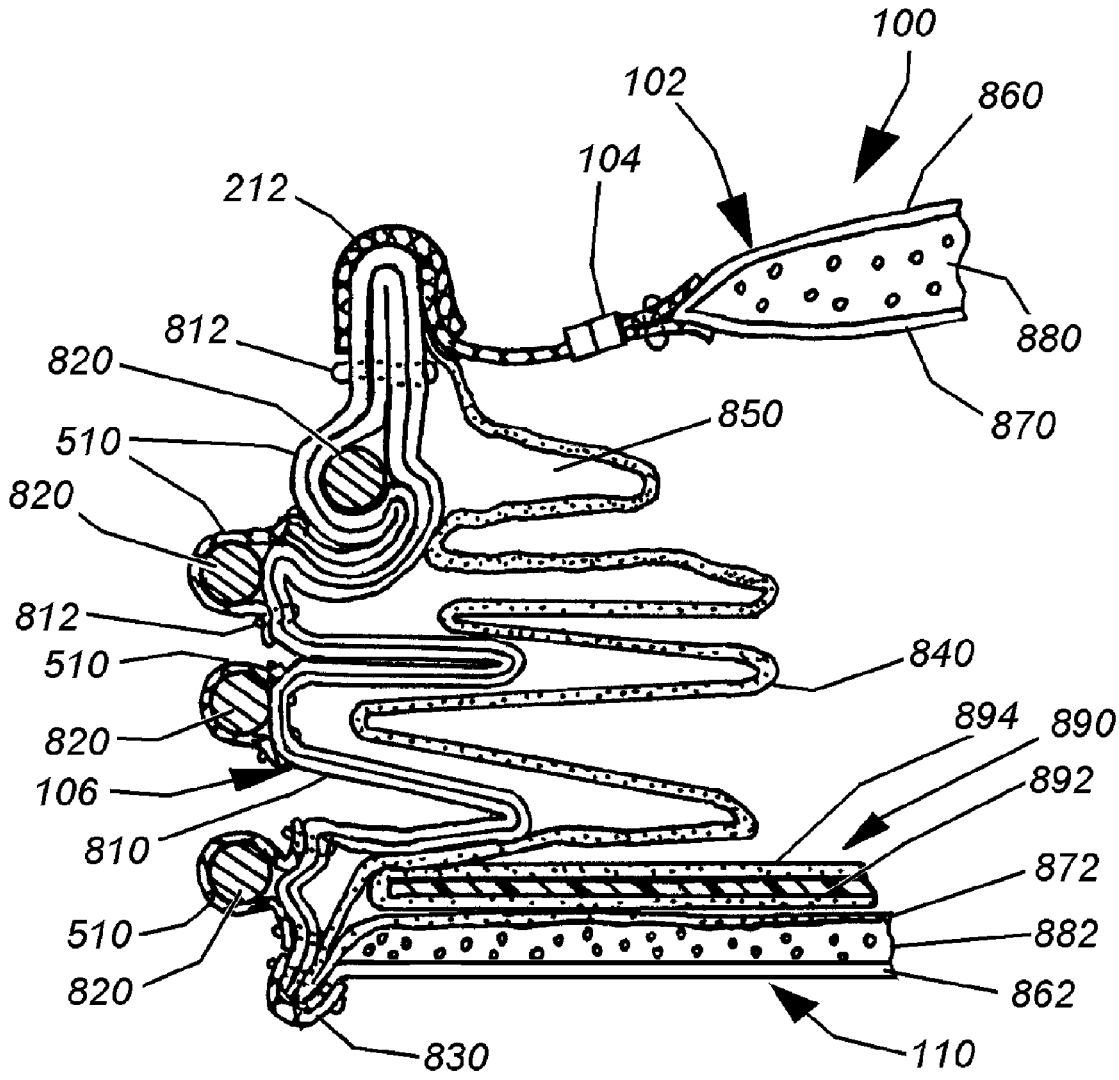
FIG. 9 is a partial side cross section of the side wall and a portion of the top and bottom surfaces of the cooler of FIG. 1 in the collapsed orientation.

Reference is now made to FIGS. 8 and 9 which show, respectively the internal structure of the top, bottom and sidewalls in both an expanded and collapsed state. As shown, the spring covering strip 510 is secured to the outer shell 810 of the sidewall 106 using stitching 812. Incased between the outer shell 810 and covering 510 is the spring rod 820. In this embodiment, the spring rod is constructed from mild steel. However, in alternate embodiments, the spring can be constructed from plastic or any other material that can be formed into an encircling spiral that possesses compression spring characteristics. As shown, the top rim 212 and bottom rim 830 secure the respective top 102 and bottom 110, and also secure ends of an inner liner 840. The inner liner can be constructed from a waterproof material such as PET plastic. It can also include a reflective or silver coating that assists in trapping heat or cold. Between the inner liner and 840 and outer shell 810 is disposed an insulating layer 850. The insulating layer encloses an "insulating material". In this embodiment, the insulating material is an airspace. However, in alternate embodiments, a filler such as foam or fibers can be employed as the insulating material. When the sidewall 106 is compressed as shown in FIG. 9, the shell 810 and insulating material 840 assume a somewhat compact but accordion-like shape that extends slightly outwardly and inwardly.

The top 102 and bottom 110 each comprise two layers. There is an outer layer 860 (top) and 862 (bottom) that can be constructed from a fabric or other material that better similar or identical to that of the shell 810 of the sidewall 106. An inner layer 870 (top) and 872 (bottom) faces the interior of the cooler. This layer can be constructed from a waterproof material similar to that of the liner 840. It can be reflective, and otherwise assist in trapping heat/cold and moister. Between the layers 860, 870, and 862, 872 is a respective layer of foam 880, 882 or another insulating material. This layer 880, 882 assists in providing a degree of rigidity to the top and bottom while still permitting needed flexibility. Such flexibility is particularly desirable in the top, which must be able to hinge back as shown in FIGS. 3 and 4. The bottom also includes a base insert 890 which includes a card stock or plastic stiffener 892. The stiffener 892 conforms generally to the perimeter shape of the cooler bottom 110. It is surrounded by a layer of waterproof material 894 that can be stitched, welded or otherwise adhered to the stiffener 892. The base 890 thus allows heavier items, such as beverage cans, to be stored in the cooler without causing the bottom 110 to deform excessively.

It should be clear that additional layers of materials, fillers, compartment spacers and other structures can be provided as appropriate. In general, the collapsible cooler of this invention advantageously stores items in a manner that retains heat or cold, due to the insulation provided. Nevertheless, the cooler exhibits a lightweight sidewall structure that enables collapsing as shown for ease of storage when not in use.

Figure 10:
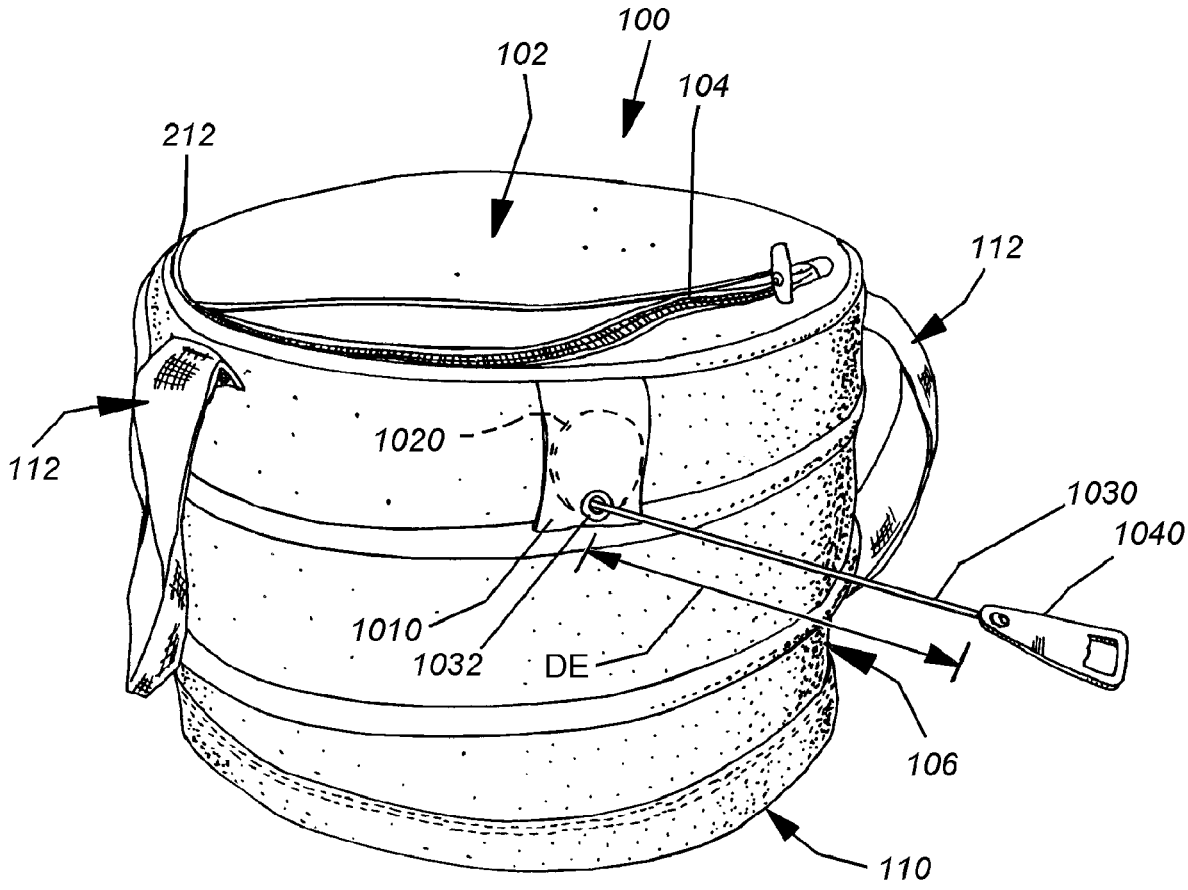
FIG. 10 is a perspective view of the cooler of FIG. 1 showing the extension of the optional, retractable-lanyard-mounted bottle opener according to an illustrative embodiment.

Reference is now made briefly to FIG. 10, in combination with FIG. 1. A useful accessory is provided along the top 102 rim 212 of the cooler. A fabric pouch 1010 sandwiches a spring loaded reel assembly 1020 (shown in phantom). The reel assembly 1020 maintains a cord or tether 1030 than can be paid out to a predetermined distance of extension DE through a grommet 1032 in the side of the pouch 1010. Upon release, the tether is retracted back into the reel assembly. The construction of a reel assembly is conventional and should be clear to those of ordinary skill. At the distal end of the tether 1030 is mounted a tool 1040. In this embodiment, the tool is a bottle opener. The tool is sufficiently large so that it does not pass through the grommet 1032. Thus, the maximum retraction of the tether 1030 is defined. In alternate embodiments, the tool can be any acceptable item including, but not limited to, a bottle opener, a can opener, a knife, a scissor or any other useful item. The reel assembly 1020 is mounted into the pouch by stitching two layers of material together and then stitching the combined layers to the rim 212. The pouch 1010 can be located at other points on the cooler as desired. In addition, multiple pouches with differing tools can be provided in alternate embodiments.

The foregoing has been a detailed description of illustrative embodiments of the invention. Various modifications and additions can be made without departing from the spirit and scope if this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the lid can comprise a flap that overlaps the fixed section and is secured by overlapping fastener pieces, such as a hook-and-loop fastener assembly. In alternate embodiments, the collapsed orientation can be maintained by structures other than the handles, such as purpose-built straps, cords or clasps. The materials used for the various layers are also highly variable. Accordingly, this description is meant to be taken only by way of example, and not to otherwise limit the scope of this invention.

What is claimed is:

1. A collapsible insulated container comprising:

a top having a zipper that extends from a first point on a rim of the top to a second point on the rim of the top, the zipper being constructed and arranged to open the top as a zipper closure member is moved from the first point on the rim toward the second point on the rim, the zipper extending on the top from the first point on the rim to an inner point on the top remote from the first point and the rim in a line along a partial radial segment, the zipper thereafter extending on the top from the inner point along a curved segment that extends to an opposing point on the rim, and therefrom along the rim to the second point, each of the partial radial segment and the curved segment thereby traversing a central region of the top;

wherein the curved segment defines a flap portion that is adapted to be pulled away and hinged along a section of the flap portion to allow access to the cooler interior free of moving the zipper closure member substantially along the rim of the container to access the cooler interior;

an insulated sidewall having a sidewall top connected to the rim of the top;

wherein the sidewall comprises an inner layer and an outer shell, wherein an insulating material is disposed between the inner liner and the outer shell;

wherein the sidewall further includes a spring wire that extends between the sidewall top and a sidewall bottom that biases the cooler to a fully expanded configuration for use and that is compressible for storage by pressing down on the top; and a bottom connected at the sidewall bottom, opposite the top.

2. The collapsible insulated container as set forth in claim 1 wherein the sidewall further includes a fabric strip applied externally thereon encasing a plurality of loops of the spring wire.

3. The collapsible insulated container as set forth in claim 1 wherein the insulating material is air.

4. The collapsible insulated container as set forth in claim 1 wherein the insulating material is at least one of a fibrous or foam filler material.

5. The collapsible insulated container as set forth in claim 1 wherein the line along a partial radial segment is substantially straight.

6. The collapsible insulated container as set forth in claim 1 wherein the line along a partial radial segment is substantially curved.

7. The collapsible insulated container as set forth in claim 1 further comprising a pouch connected externally thereto having a spring-loaded reel assembly disposed therein that maintains a retractable tether having a tool secured at its distal end.

8. The collapsible insulated container as set forth in claim 7 wherein the tool is a bottle opener.

* * * * *